United States Patent [19]

Herrman

[11] Patent Number: 5,058,708

[45] Date of Patent: Oct. 22, 1991

[54] SCAFFOLD AND HOIST STRUCTURE

[76] Inventor: Hilbert J. Herrman, 1401 Jefferson, Great Bend, Kans. 67530

[21] Appl. No.: 502,860

[22] Filed: Apr. 2, 1990

[51] Int. Cl.[5] ..... B66B 1/20; E04G 1/18; E04G 21/00

[52] U.S. Cl. ..... 182/129; 182/145; 187/2; 187/6

[58] Field of Search ..... 182/129, 142, 143, 145; 187/2, 6, 9 R, 11

[56] References Cited

U.S. PATENT DOCUMENTS

| | | | |
|---|---|---|---|
| 329,497 | 11/1885 | Spitzer . | |
| 464,433 | 12/1891 | Gordon . | |
| 1,950,289 | 3/1934 | Benson . | |
| 2,390,284 | 12/1945 | Woody | 182/145 |
| 2,569,653 | 10/1951 | Boedecker | 182/145 |
| 2,798,574 | 7/1957 | Wardell | 182/129 |
| 2,803,503 | 8/1957 | Borgman | 182/145 |
| 2,829,929 | 4/1958 | Wardell . | |
| 2,833,596 | 5/1958 | Borgman | 182/145 |
| 2,985,428 | 5/1961 | Isbell . | |
| 3,313,376 | 4/1967 | Holland | 182/129 |
| 3,752,263 | 8/1973 | Thevenot | 187/2 |
| 4,378,860 | 4/1983 | Newberry . | |
| 4,386,680 | 6/1983 | Reed . | |
| 4,938,310 | 7/1990 | Larsen | 182/142 |

*Primary Examiner*—Reinaldo P. Machado

*Attorney, Agent, or Firm*—Litman, McMahon & Brown

[57] ABSTRACT

A hoist for a scaffold assembly includes a track assembly with starter, extension and head sections adapted for mounting on lower, intermediate and upper frames of the scaffold assembly. The head track section includes an upper end with a suspension subframe cantilevering therefrom. A carriage assembly is movably mounted on the track assembly and is raised and lowered by a winch assembly including a tensile member connected to a winch and the carriage assembly.

22 Claims, 4 Drawing Sheets

SCAFFOLD AND HOIST STRUCTURE

BACKGROUND OF THE INVENTION

1. Field of the Invention

The present invention relates generally to hoists, and in particular to a construction materials hoist for mounting on scaffolding.

2. Description of the Prior Art

In the construction industry, materials, workers and equipment must often be elevated from lower levels on construction sites to higher levels where their presence is required. Various types of cranes, hoists and elevators have heretofore been utilized to accomplish these tasks.

Temporary scaffolding is commonly employed in construction to provide elevated staging areas for materials, workers and equipment. Such scaffolding is available in generally rectangular frames, which are set up in pairs interconnected by diagonal bracing to form relatively rigid scaffolding frameworks. The frames are often stackable so that scaffolding systems can be assembled to various heights. Typically, planks are extended between the spaced scaffolding frames to provide staging areas for the materials, workers and equipment.

An exemplary use of such a scaffolding system is in masonry construction, which often requires the elevation of relatively large amounts of materials. As the masonry construction progresses upwardly, mortar and the masonry units (e.g. bricks, blocks, stones, etc.) are lifted to staging areas on the scaffolding system at appropriate heights.

On many masonry construction jobs, the materials are elevated entirely by manual laborers known in the industry as "hod carriers". However, manually stocking an elevated work staging area with masonry materials tends to be relatively time-consuming and expensive, especially since hod carriers normally lift only ten bricks or so at a time. Naturally, the time and expense of manually stocking a staging area increases with the height to which the materials must be elevated. To reach a staging area atop multiple scaffolding levels, the materials must be lifted and set down through a series of intermediate staging areas, the vertical separation of which is limited by the height that a hod carrier can elevate the materials in one motion.

To overcome some of the aforementioned problems associated with manually elevating construction materials to scaffolding staging areas, hoists have heretofore been combined with scaffold systems. For example, the Isbell U.S. Pat. No. 2,985,428 shows a scaffold structure with a pair of winch mechanisms for raising and lowering a work platform. The Wardell U.S. Pat. No. 2,829,929 shows a scaffold assembly with a hoist carriage movably mounted on vertical trackway sections. A crane assembly is provided for raising and lowering the hoist carriage by means of a cable attached to the carriage and to suitable hoisting machinery. However, such prior art hoist and scaffold combinations tended to be relatively complex, incompatible with existing scaffolding systems, difficult to set up and take down, and otherwise generally unsuited for many construction projects requiring the elevation of materials, workers and equipment. Consequently, on many construction projects, materials, workers and equipment are still manually elevated in much the same manner as they have been for centuries.

The present invention addresses the aforementioned problems.

SUMMARY OF THE INVENTION

In the practice of the present invention, a hoist is provided for a scaffold assembly including lower, intermediate and upper frames, each frame having upper and lower crossbars. The hoist includes a track assembly with starter, extension and head track sections adapted for mounting on the crossbars of the lower, intermediate and upper scaffold frames respectively. The head track section includes an upper end with a suspension subframe cantilevering therefrom. Each track section includes a pair of vertical rails. A carriage assembly includes a partially-enclosed carriage with a back having upper and lower pairs of guide clips mounted thereon and slidably receiving the rails. A winch assembly includes pulleys mounted on the suspension subframe, a block and hook subassembly adapted for attachment to the carriage and a tensile member reeved on the block and hook subassembly and the pulleys. A winch is provided for retracting and extending the tensile member whereby the carriage is raised and lowered respectively.

OBJECTS OF THE INVENTION

The principal objects of the present invention are: to provide a hoist; to provide such a hoist for a scaffold assembly; to provide such a hoist which is adapted for mounting on commonly available scaffold frames; to provide such a hoist which is adapted for raising and lowering materials, workers and equipment; to provide such a hoist which is particularly well adapted for use in construction; to provide such a hoist which is particularly well adapted for use in connection with masonry construction; to provide such a hoist which is adapted for expeditiously and safely elevating masonry construction materials; to provide such a hoist which is adaptable to scaffold assemblies of various heights; and to provide such a hoist which is economical in construction, efficient in operation, capable of a long operating life and is particularly well adapted for the prosposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF PREFERRED EMBODIMENTS

I. Introduction

Figure 1:
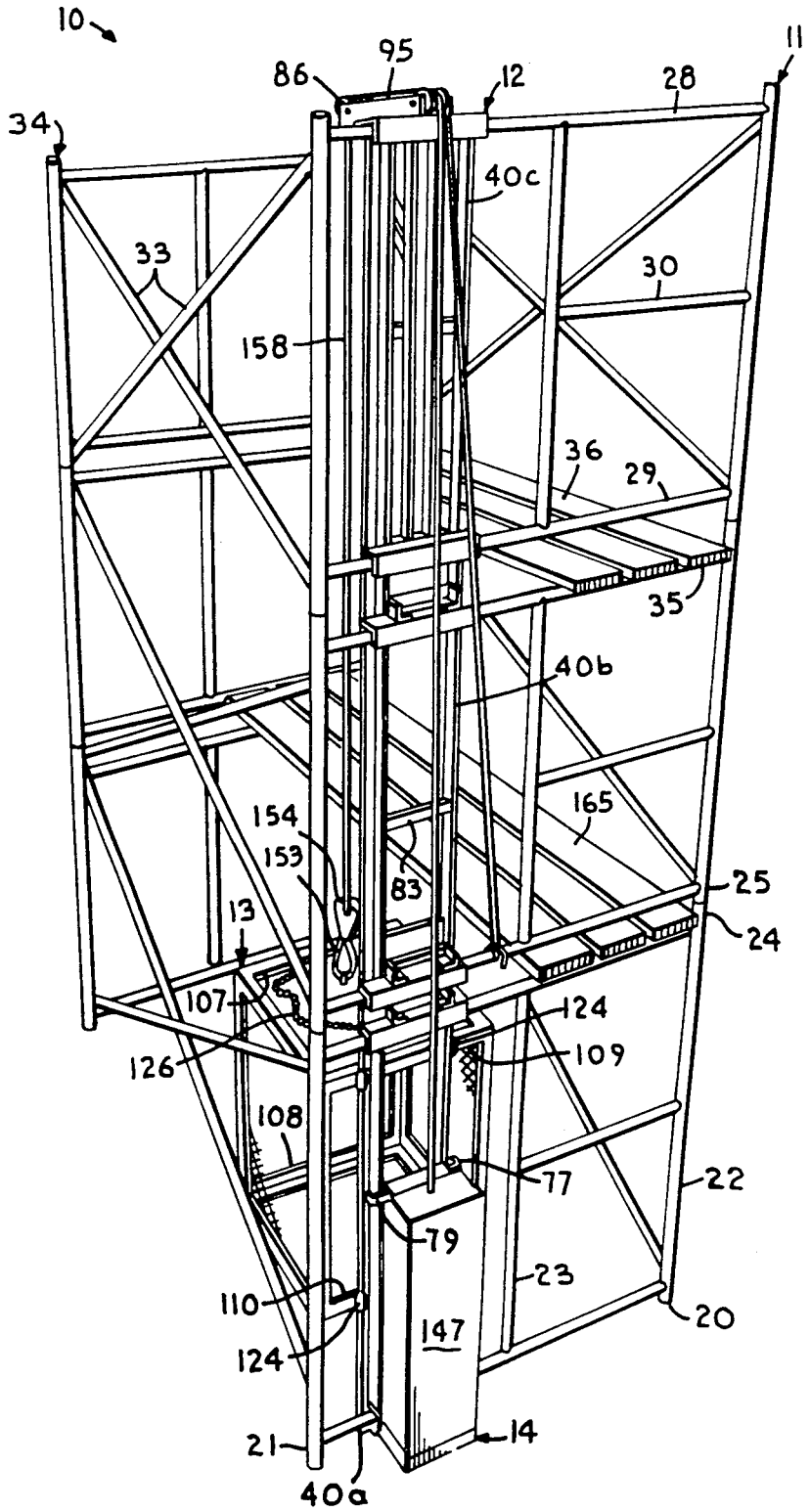
FIG. 1 is a perspective view of a hoist embodying the present invention mounted on a scaffold system.
Figure 2:
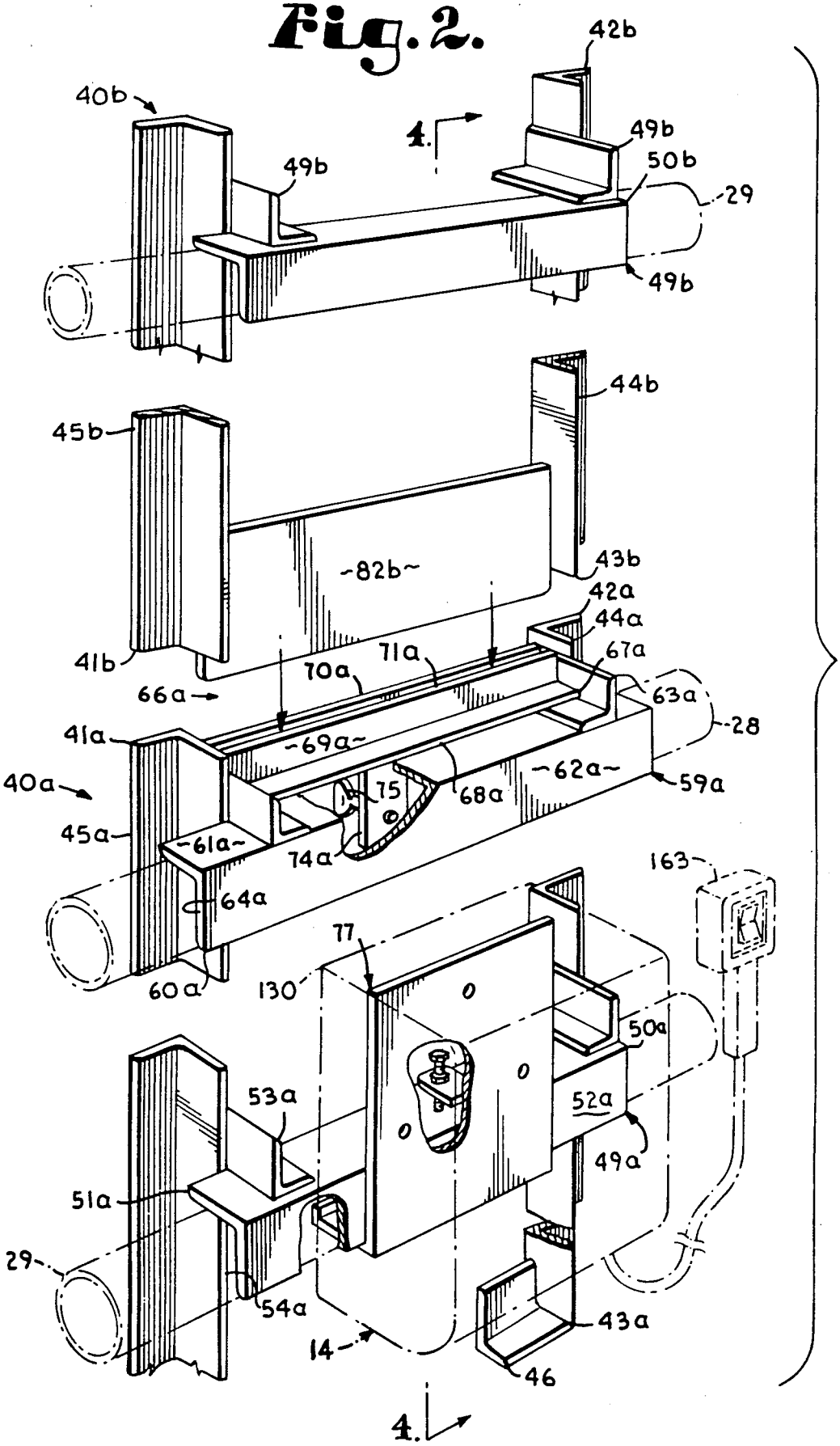
FIG. 2 is an enlarged, fragmentary, perspective view of a lower portion of the hoist.
Figure 3:
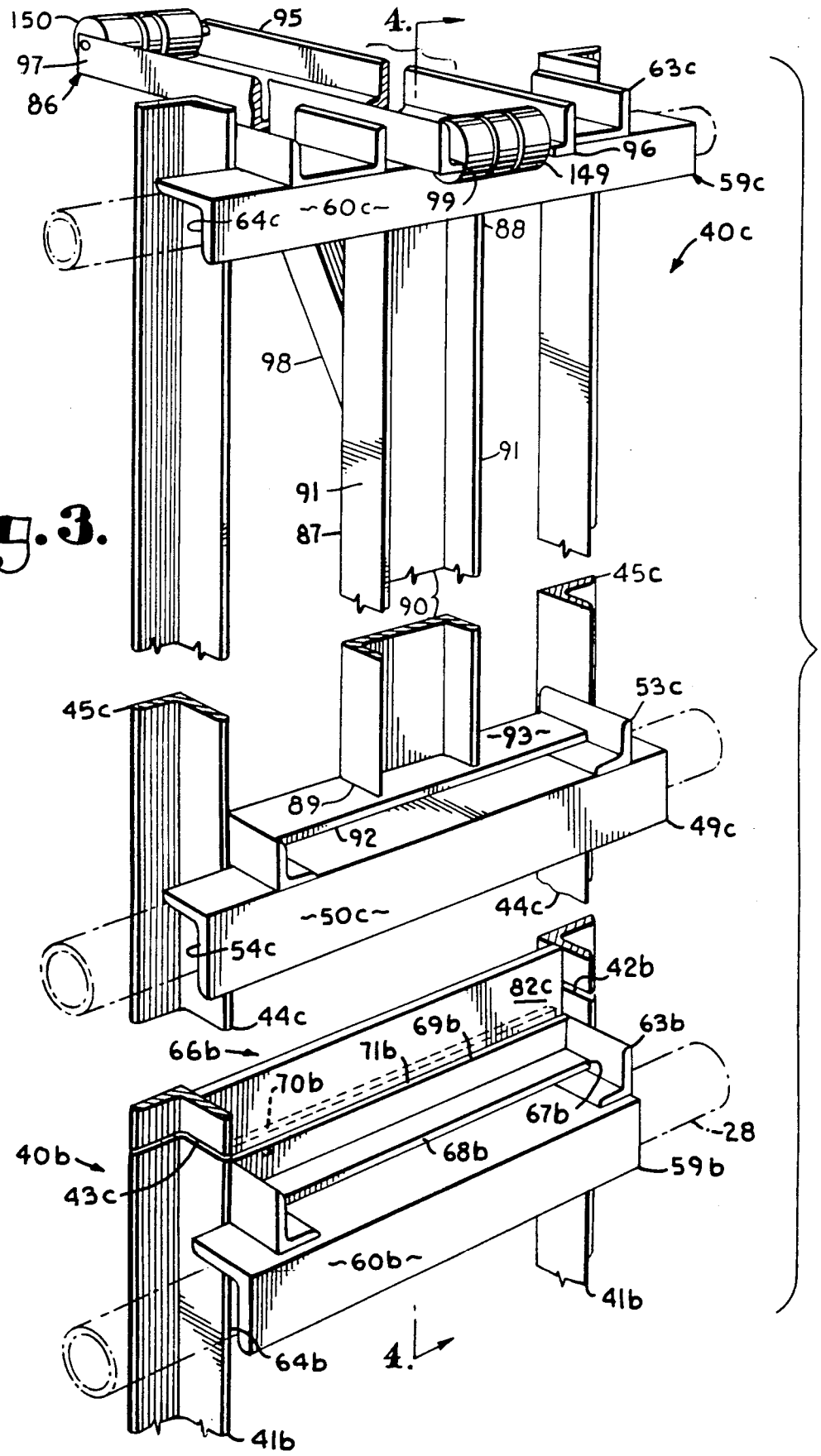
FIG. 3 is an enlarged, fragmentary, perspective view of an upper portion of the hoist.
Figures 4, 5:
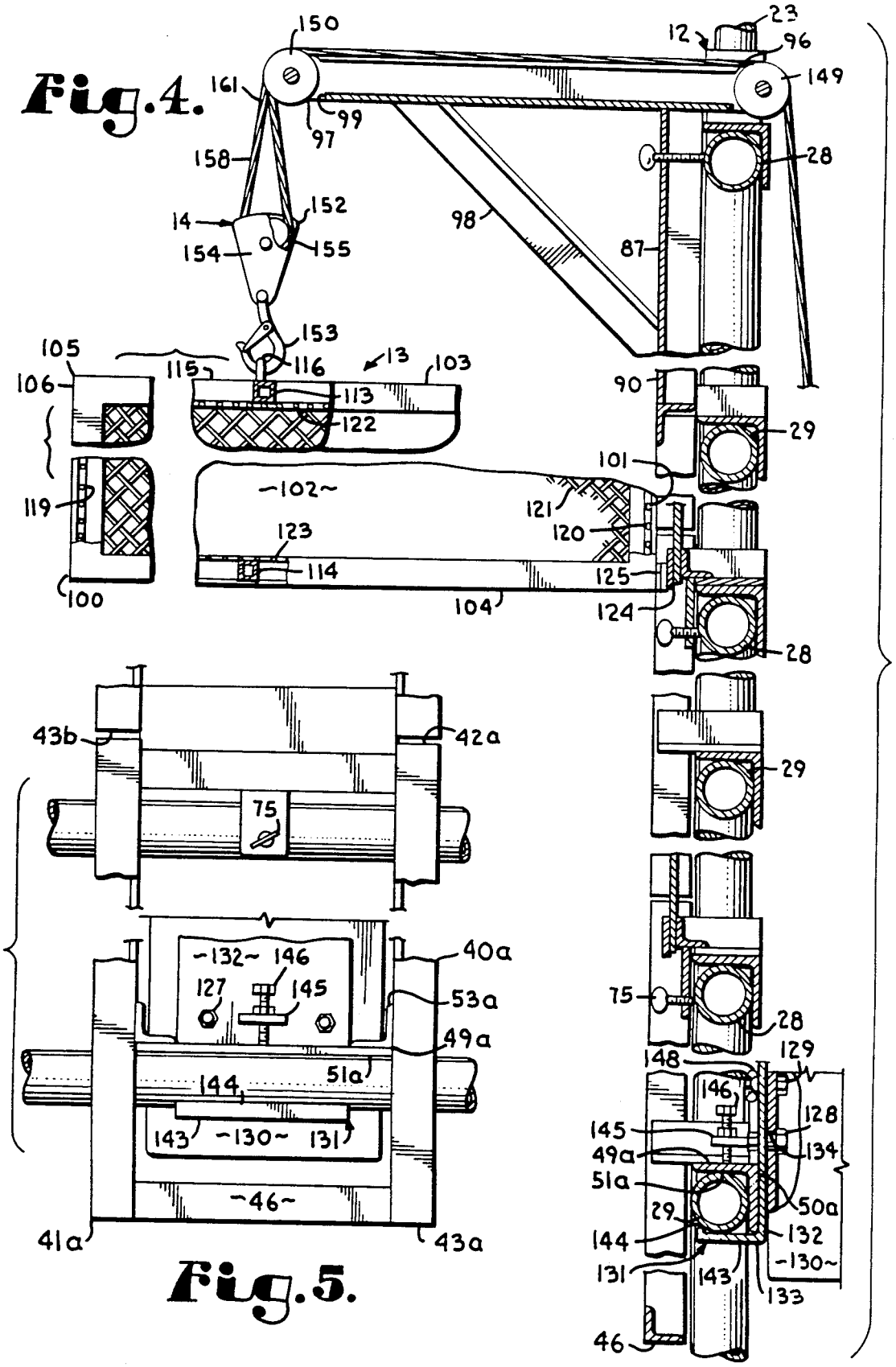
FIG. 4 is a vertical, cross-sectional view of the hoist taken generally along lines 4—4 in FIGS. 2 and 3.
FIG. 5 is a fragmentary front elevational view of the hoist.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 10 generally designates a combined scaffold and hoist embodying the present invention. The scaffold and hoist 10 generally includes a scaffold assembly 11, a track assembly 12, a carriage assembly 13 and a winch assembly 14. For exemplary orientation purposes only, the carriage assembly 13 is on the front of the track assembly 12, and the winch assembly 14 is on the back of the track assembly 12.

II. Scaffold Assembly

The scaffold assembly 11 is of conventional construction and includes a plurality (six are shown) of frames 20, each comprising first and second outer columns 21, 22 and an intermediate column 23 therebetween. Each outer column 21, 22 terminates at an upper male end 24 and a lower female end 25 which are adapted for telescopic interconnection whereby the frames 20 can be stacked as shown in FIG. 1.

Upper and lower crossbars 28, 29 extend transversely between the outer columns 21, 22 and an intermediate crossbar 30 extends transversely between the second outer column 22 and the intermediate column 23 in parallel, spaced relation approximately halfway between the upper and lower crossbars 28, 29. The columns 21, 22 and 23 and the crossbars 28, 29 and 30 may comprise lengths of steel pipe welded together at their interconnections whereby each frame 20 is relatively rigid.

The frames 20 are normally set up at job sites in pairs, each pair of frames 20 being innerconnected at their respective column upper and lower ends 24, 25 by diagonal braces 33. In the embodiment of the present invention illustrated in FIG. 1, three pairs of frames 20 are stacked one on top of another to form a rigid, structural scaffold framework 34. Planks 35 are extended between corresponding pairs of crossbars 28, 29 and 30 to form staging areas 36 at desired locations on the framework 34. The staging areas 36 are adapted to support materials, workers and equipment where necessary adjacent to a structure (not shown) under construction. The scaffold assembly 11 described thus far is of a type commonly used in construction. It will be appreciated that its components can be relatively easily assembled, disassembled and transported.

III. Track Assembly

The track assembly 12 includes starter, extension, and head guide sections 40*a*, 40*b* and 40*c*. Corresponding parts of the sections 40*a*, 40*b* and 40*c* will be designated by corresponding reference numerals differentiated by the suffixes "a" (starter), "b" (extension) and "c" (head).

The starter track section 40*a* includes a pair of angle-section rails 41*a* terminating at upper and lower ends 42*a*, 43*a*; inner flanges 44*a* projecting perpendicularly and forwardly from a frame 20 and outer flanges 45*a* extending parallel to the frame 20. A bottom angle section crosspiece 46 connects the rail lower ends 43*a*.

A lower mounting subassembly 49*a* is attached to the rails 41*a* in spaced relation above the bottom crosspiece 46 and comprises an angle-section lower mounting crosspiece 50*a* with a horizontal flange 51*a* and a vertical flange 52*a*. The lower mounting crosspiece 50*a* is attached to the rails 41*a* by a pair of angle-section gussets 53*a* welded to the rail inner flanges 44*a* and the lower mounting crosspiece horizontal flange 51*a* whereby the lower mounting crosspiece vertical flange 52*a* is spaced rearwardly from the rail inner flanges 44*a* to define a crossbar-receiving channel 54*a* therebetween for receiving a lower crossbar 29.

An upper mounting subassembly 59*a* is connected to the rail upper ends 42*a*. The upper mounting subassembly 59*a* includes: an angle-section upper mounting crosspiece 60*a* with horizontal and vertical flanges 61*a*, 62*a*; gussets 63*a*; and a crossbar-receiving channel 64*a*, all arranged in a configuration like that of the lower mounting subassembly 49*a*. Preferably the mounting subassemblies 49*a*, 59*a* are vertically adjustable on the rails 41*a* so that scaffold frames 20 with crossbars 28, 29 having different spacings can be accomodated.

An angle-section alignment member 67*a* is fastened to the gussets 63*a* and extends between the rail upper ends 42*a*. The alignment member 67*a* includes horizontal and vertical flanges 68*a*, 69*a*. An alignment bar 70*a* extends between the rail upper ends 42*a* and forms a vertically-oriented, upwardly-open alignment slot 71*a* with the alignment member vertical flange 69*a*. The alignment member and bar 67*a*, 70*a* form an alignment subassembly 66*a*. A set screw plate 74*a* depends downwardly from the horizontal flange 68*a* of the alignment member 67*a* and threadably receives a set screw 75*a* which is adapted to engage a respective upper crossbar 28 positioned in the channel 64*a*.

The extension track section 40*b* includes: rails 41*b*; upper and lower mounting subassemblies 49*b*, 59*b*; an alignment subassembly 66*b*; a set screw plate 74*a*; and a set screw 75*a*, all in substantially the same configuration as the starter track section 40*a*.

An alignment tab 82*b* extends between the rails 41*a* and projects downwardly below the rail lower ends 43*b* for receipt in the alignment slot 71*a* at the top of the starter track section 40*a*. An angle-section crosspiece 83 extends transversely between the rail inner flanges 44*b* approximately intermediate the upper and lower mounting subassemblies 49*b*, 59*b*.

The head track section 40*c* includes: rails 41*c*; a lower mounting subassembly 49*c*; an upper mounting subassembly 59*c* and an alignment tab 82*c*, all having substantially the same configuration as the starter and extension track sections 40*a*, 40*b*.

A suspension subframe 86 cantilevers forwardly from the upper end of the head track section 40*c* and includes a vertical channel 87 with upper and lower ends 88, 89; a web 90; and a pair of flanges 91. An angle-section channel support 92 extends transversely between the rails 41*c* adjacent the lower mounting subassembly 59*c* and includes a horizontal flange 93 welded to the channel lower end 89 and a vertical flange 94. The suspension subframe 86 further includes a horizontal channel 95 with a proximate end 96 mounted in spaced relation above the upper mounting crosspiece horizontal flange 61*c* and the vertical channel upper end 88 by a pair of angle-section connecting members 85 which are welded to the horizontal channel 95 and the upper mounting crosspiece 60*c*. The horizontal channel 95 terminates a a distal end 97. Each horizontal channel end 96, 97 includes a notch 99. A brace channel 98 extends diagonally from the horizontal channel 95 in spaced relation from its distal end 97 to the vertical channel in spaced relation below its upper end 88, and serves to reinforce the suspension subframe 86.

IV. Carriage Assembly

The carriage assembly 13 includes a front 100, a back 101, opposite sides 102, a top 103 and a bottom 104. A generally rectangular framework 105 includes corner uprights 106, upper and lower front cross members 107, 108; upper and lower back cross members 109, 110; and upper and lower side cross members 111, 112. Top and bottom reinforcing subframes 113, 114 are provided, the top reinforcing subframe 113 converging radially at a center 115 mounting a loop 116.

The carriage framework 105 is partly enclosed by front and back panels 119, 120; removable side panels 121 and top and bottom panels 122, 123. The carriage panels 119–123 may comprise expanded metal or some other suitable material.

Upper and lower pairs of U-section track guide clips 124 are mounted in spaced relation on the upper and lower back cross members 109, 110, each pair of track guide clips 124 defining a pair of inwardly-opened track guide clip channels 125 adapted to slidably receive the rail outer flanges 45*a*, 45*b* and 45*c*. As an alternative to the track guide clips 124, rollers may be mounted on the carriage framework 105 for rollingly engaging the rail outer flanges 45*a*, 45*b* and 45*c*. The carriage assembly 13 includes a safety chain 126 for looping over the horizontal channel 95 when the carriage assembly 13 is in a raised position.

V. Winch Assembly

The winch assembly 14 includes a motorized winch 130 mounted on the lower mounting subassembly 49*a* by a winch mounting subassembly 131. The winch mounting subassembly 131 includes a plate 132 with a lower edge 133 and a horizontal leg 143 projecting forwardly from the plate lower edge 133 and terminating at an upturned lip 144. A set screw plate 145 extends forwardly from the plate 132 in spaced relation above the horizontal leg 143 and threadably receives a set screw 146. The set screw 146 is adapted to engage the horizontal flange 51*a* of the lower mounting crosspiece 50*a* whereby the horizontal leg 143 is clamped tightly against the lower crossbar 29. The winch 130 is mounted on the plate 132 and projects rearwardly therefrom.

The winch mounting subassembly 131 may be adapted to accomodate a variety of motorized winches, which may be bolted or otherwise fastened to the winch mounting plate 132. For example, a suitable motorized winch (e.g. Model No. SA12000AC, trademark "StrongArm") is available from the Dutton-Lainson Company in Hastings, Nebr. The StrongArm electric winch Model No. SA12000AC can be mounted by welding nuts 127 to the front face of the plate 132 for receiving shoulder stud bolts 128 which project rearwardly from the plate 132 and are received in keyhole slots 134 in the base of the winch 130. A retainer bolt 129 and a wing nut 148 are provided for securing the winch 130 to the plate 132.

Alternatively, a winch hanger subassembly 77 is provided on the starter track section 40*a* between its mounting subassemblies 49*a*, 59*a*. The winch hanger subassembly 77 includes a transverse winch hanger bar 79. FIG. 1 shows an alternative motorized winch 147 mounted at its upper end on the winch hanger subassembly 77 and at its lower end on the scaffold frame lower crossbar 29. The winch mounting subassembly 131 is not used for mounting the winch 147. A winch such as that shown at 147 (e.g. Model No. 200-EX, trademark "Ladder Platform Hoist" or "Power Hoist") is available from the Louisville Ladder Company of Louisville, Ky. Other types of winches, such as hand-crank crank winches and winches driven by gasoline engines may also be employed.

The winch assembly 14 includes a proximate pair of pulleys 149 mounted at the horizontal channel proximate end 96 and a distal pair of pulleys 150 mounted at the horizontal channel distal end 97. The pulleys 149, 150 are received in the notches 99 at the horizontal channel proximate and distal ends 96, 97.

A block and hook subassembly 152 includes a releasable hook 153 adapted for snapping on the carriage loop 116 and a block 154 with a pulley 155. A tensile member 158 (e.g. a steel cable) includes a proximate end (not shown) secured within the winch 130. From the winch 130 the cable 158 passes over an associated pair of proximate and distal pulleys 149, 150 along one side of the horizontal channel 95, around the block and hook subassembly pulley 155; over the proximate and distal pulleys 149, 150 along the other side of the horizontal channel 95; and terminates at a distal end 161 secured to the scaffold framework 34. The winch 130 may be reversible, and may include a remote switch 163.

VI. Operation

In operation, the scaffold framework 34 is erected at a desired location on a construction site, for example adjacent to a building under construction. The planks 35 are laid on the corresponding desired crossbars 28, 29 and 30 to provide staging area platforms 165 as needed. The carriage assembly 13 is placed in position within the scaffold framework 34 in front of a respective lowermost scaffold frame 20. The starter track section 40*a* is lowered onto the carriage assembly 13 by sliding the rail outer flanges 45*a* into the corresponding track clip channels 125. The starter track section 40*a* is then mounted on the front of the frame 20 by placing the upper and lower crossbars 28, 29 in the channels 64*a*, 54*a* of the upper and lower mounting assemblies 59*a*, 49*a* respectively. The set screw 75 is then tightened against the upper crossbar 28. It will be appreciated that practically any number of extension track sections 40*b* can be stacked one on top of another to accomodate a scaffold framework of any practical height, safety considerations being the primary limitation on height.

An extension track section 40*b* is properly positioned on the next frame 20 by inserting its alignment tab 82*b* into the starter track section alignment slot 71*a*. The mounting subassemblies 49*b*, 59*b* of the extension track section 40*b* are secured to the lower and upper crossbars 29, 28 in the same manner as the starter track sections. Likewise, the head track section 40*c* attaches to an extension track section 40*b* and to a frame 20 in a manner similar to the extension track section 40*b*.

With the track assembly 12 thus assembled, the winch 130 or 147 is mounted on the starter track section 40*a* and the cable 158 is reeved over the pulleys 149, 150 and 155. The cable distal end 161 may be secured to the scaffold framework 34. One or both of the carriage side panels 121 may be removed as necessary and the carriage loaded with construction materials for raising and lowering on the scaffold assembly 11. In a raised position, the safety chain 126 is preferably placed over the horizontal channel 95 as a redundant safety measure. Preferably the winch 130 or 147 has a ratchet or brake mechanism that prevents inadvertent slippage from a raised position.

It is to be understood that while certain forms of the present invention have been illustrated and described herein, it is not to be limited to the specific forms or arrangement of parts described and shown. For example, the track sections 40*a*, 40*b* and 40*c* can be permanently affixed (e.g. welded or bolted) to the scaffold frames 20.

What is claimed and desired to be secured by Letters Patent is as follows:

1. A hoist, which includes:

(a) a track assembly including:

(1) an upper end;

(2) a lower end;

(3) a vertical rail extending between said upper and lower ends; and (4) a suspension subframe cantilevering from said track assembly upper end;

(b) a carriage assembly including guide means adapted for engaging said rail and guiding said carriage vertically therealong between raised and lowered positions; and (c) winch means mounted on said track assembly and including a tensile member connected to said suspension subframe and said carriage, said winch means being adapted for raising and lowering said carriage between its raised and lowered positions.

2. The hoist according to claim 1 wherein said track assembly includes:

(a) a starter section having upper and lower ends and mounting said winch means;

(b) a head section having upper and lower ends and mounting said suspension subframe at said upper end; and (c) track section connection means adapted for innerconnecting said starter section upper end and said head section lower end.

3. The hoist according to claim 2 wherein:

(a) said track section connection means comprises a slot on one of said innerconnected track section ends and a tab on the other of said innerconnected track section ends, said slot being adapted to receive said tab.

4. The hoist according to claim 1, which includes:

(a) a pair of said vertical rails, each said rail comprising an angle-section member.

5. The hoist according to claim 4 wherein said winch means includes:

(a) a winch hanger subassembly having a pair of gussets each mounted on a respective rail intermediate said rail upper and lower ends and a winch hanger bar extending transversely between and attached to said gussets; and (b) a winch mounted on said winch hanger bar.

6. The hoist according to claim 4 wherein said carriage assembly guide means includes:

(a) upper and lower post pairs of guide clips each forming a guide clip channel adapted to receive a respective rail.

7. The carriage assembly according to claim 4 wherein said guide means includes:

(a) upper and lower post pairs of guide rollers each adapted to engage a respective rail.

8. The hoist according to claim 1 wherein:

(a) said suspension subframe includes a proximate end attached to said track assembly upper end and a distal end;

(b) said winch means includes a proximate pulley at said suspension subframe proximate end and a distal pulley at said suspension subframe distal end; and (c) said tensile member being connected to said proximate and distal pulleys.

9. The hoist according to claim 8 wherein:

(a) said winch means includes a block with a block pulley connected to said carriage and receiving said tensile member.

10. In combination with a scaffold system including a pair of scaffold frames each having upper and lower horizontal crossbars, said scaffold frames being oriented vertically and positioned in parallel, spaced relation, the improvement of a hoist, which comprises:

(a) a track assembly including:

(1) an upper end;

(2) a lower end;

(3) a rail extending vertically between said upper and lower ends;

(4) a lower mounting subassembly adapted for mounting said rail on a respective scaffold frame lower crossbar;

(5) an upper mounting subassembly adapted for mounting said rail on a respective scaffold frame upper crossbar; and (6) a suspension subframe attached to and extending from said upper end;

(b) a carriage assembly including guide means adapted for movably engaging said rail for guiding said carriage assembly along said rail between raised and lowered positions; and (c) a winch assembly mounted on said track assembly and including a tensile member connected to said suspension subframe and said carriage assembly, said winch being adapted to retract and extend said tensile member whereby said carriage assembly is respectively raised and lowered.

11. The combination according to claim 10 wherein said track assembly includes:

(a) a starter section having upper and lower ends and mounting said winch;

(b) a head section having upper and lower ends and mounting said suspension subframe; and (c) track section connection means adapted for innerconnecting said starter section upper end and said head section lower end.

12. The combination according to claim 11 wherein said track section connection means comprises:

(a) one of said starter section upper ends and said head section lower end forming a vertical alignment slot; and (b) the other of said starter section upper end and head section lower end having an alignment tab receivable in said alignment slot whereby said starter and head track sections are innerconnected with said rails thereof vertically aligned.

13. The combination according to claim 11 wherein:
(a) each said track section includes a parallel pair of said rails, each said rail comprising an angle-section member with inner and outer flanges.

14. The combination according to claim 13 wherein said lower and upper and mounting assemblies each comprise:
(a) a transverse angle-section mounting member including a horizontal flange attached to said rail inner flanges and a vertical flange positioned in parallel, spaced relation with respect to said rails; and
(b) a channel formed by said angle-section mounting member and said rails, said channel being adapted to receive a respective scaffold frame crossbar.

15. The combination according to claim 14 wherein:
(a) each said mounting subassembly includes:
(1) a pair of gussets each attached to a respective rail inner flange and a respective crosspiece horizontal flange.

16. The combination according to claim 11 wherein said track assembly includes:
(a) an extension track section having upper and lower ends and connection means adapted for connecting said extension track section lower end to said starter track section upper end and adapted for connecting said extension track section upper end to said head track section lower end.

17. The combination according to claim 10 wherein said suspension subframe includes:
(a) a vertical member having upper and lower ends connected to said upper and lower mounting subassemblies respectively; and
(b) a horizontal member having a proximate end connected to said upper mounting subassembly and a distal end.

18. The combination according to claim 17 wherein said suspension subframe includes:
(a) a diagonal brace member connected to said vertical suspension subframe member intermediate the upper and lower ends thereof and to said horizontal suspension subframe member intermediate the proximate and distal ends thereof; and
(b) said suspension subframe vertical, horizontal and diagonal brace members having channel-section configurations.

19. The combination according to claim 13 wherein said carriage assembly guide means comprises upper and lower pairs of guide clips each forming an inwardly-open channel adapted for slidably receiving a respective rail outer flange.

20. The combination according to claim 17 wherein:
(a) said winch assembly includes proximate and distal pulleys mounted on said horizontal member proximate and distal ends respectively; and
(b) said tensile member being reeved over said pulleys.

21. The combination according to claim 10 wherein said winch assembly includes:
(a) a winch mounting subassembly having a vertically-oriented plate with upper and lower edges, a horizontal leg extending from said plate lower edge and a lip extending upwardly from said leg, said winch mounting subassembly being adapted to engage said scaffold frame lower crossbar and said track assembly lower mounting subassembly, and said winch being adapted for mounting on said winch mounting subassembly plate.

22. In combination with a scaffold assembly including lower, intermediate and upper scaffold frames each having upper and lower horizontal crossbars, said scaffold frames being stacked vertically, the improvement of a hoist, which comprises:
(a) a lower track section including:
(1) a pair of angle-section rails with upper and lower ends and inner and outer flanges;
(2) a bottom crosspiece extending between said rail lower ends;
(3) a lower mounting subassembly positioned above said bottom crosspiece and including an angle-section mounting crosspiece and a pair of gussets each attached to a respective rail and said mounting crosspiece, said mounting crosspiece forming a channel with said rails, said channel being adapted to receive said lower scaffold frame lower crossbar;
(4) an upper mounting assembly extending between said rails in proximity to said rail upper ends and including an angle-section mounting crosspiece and a pair of gussets each attached to a respective rail and said upper mounting crosspiece, said upper mounting crosspiece forming a channel with said rails adapted to receive said lower scaffold frame upper crossbar;
(5) set screw means attached to said upper mounting assembly and including a set screw adapted to impinge said lower scaffold frame upper crossbar; and
(6) an alignment subassembly including an angle-section alignment member extending horizontally between said rails and including horizontal and vertical flanges, an alignment bar extending horizontally between said rails in spaced relation from said angle-section alignment member and forming a vertically-oriented alignment slot therewith;
(b) an extension tract section;
(c) a head track section including:
(1) a suspension subframe having a channel member with a proximate end attached to said upper mounting subassembly and a distal end, said suspension subframe including a channel-section support member attached to and extending vertically between said upper and lower mounting subassemblies, said suspension subframe further including a brace member extending between said horizontal channel and said vertical channel;
(d) a carriage assembly including:
(1) a front;
(2) a back;
(3) opposite sides;
(4) a top;
(5) a bottom;
(6) a framework comprising uprights, upper and lower front cross members, upper and lower back cross members and opposite pairs of upper and lower side cross members;
(7) a top reinforcing subframe;
(8) a bottom reinforcing subframe;
(9) a loop on said top reinforcing subframe; and
(10) upper and lower pairs of guide clips mounted on said upper and lower back cross members respectively, each said guide clip including a channel adapted to slidably receive a respective rail outer flange; and
(e) a winch assembly including:

(1) a block and hook subassembly including a hook adapted to engage said loop and a block including a pulley;

(2) proximate and distal suspension subframe pulleys mounted on said horizontal channel member proximate and distal ends respectively;

(3) a tensile member having a distal end secured to said scaffold framework, said tensile member passing over said proximate and distal pulley pairs and being reeved over said block and hook subassembly pulley and a proximate end;

(4) a winch capturing said tensile member proximate end and adapted for retracting said tensile member whereby said carriage assembly is raised and extending said tensile member whereby said carriage assembly is lowered; and (5) a winch mounting subassembly mounting said winch assembly on said lower mounting subassembly of said lower track section.

* * * * *